United States Patent [19]

Berner

[11] Patent Number: 4,751,949

[45] Date of Patent: Jun. 21, 1988

[54] WOOD CHIPPING

[76] Inventor: Alois Berner, Burg Feuerstein, D-8553 Ebermannstadt, Fed. Rep. of Germany

[21] Appl. No.: 47,507

[22] Filed: May 1, 1987

Related U.S. Application Data

[63] Continuation of Ser. No. 770,400, Aug. 28, 1985, abandoned.

[30] Foreign Application Priority Data

Aug. 28, 1984 [DE] Fed. Rep. of Germany ..... 3441550

[51] Int. Cl.[4] ..... B27L 7/00; B27C 1/00

[52] U.S. Cl. ..... 144/162 R; 83/345; 83/399; 144/193 A; 144/193 D

[58] Field of Search ..... 144/162 R, 182, 180, 144/193 R, 193 A, 193 D; 83/117, 345, 387, 399, 575

[56] References Cited

U.S. PATENT DOCUMENTS

| | | | |
|---|---|---|---|
| 1,814,726 | 7/1931 | Miller | 144/162 R |
| 2,530,590 | 11/1950 | White et al. | 144/162 R |
| 2,592,782 | 4/1952 | Zweifel et al. | 144/162 R |
| 2,604,913 | 7/1952 | Bamford | 144/162 R |
| 2,760,533 | 8/1956 | Bass | 144/162 R |

*Primary Examiner*—W. Donald Bray
*Attorney, Agent, or Firm*—Ralf H. Siegemund

[57] ABSTRACT

A wood cutting machine having a knife-like blade for cutting and chipping wood into large pieces. The blade is oriented at an angle to the direction of wood grain thereby lowering the force required to cut the wood.

15 Claims, 2 Drawing Sheets

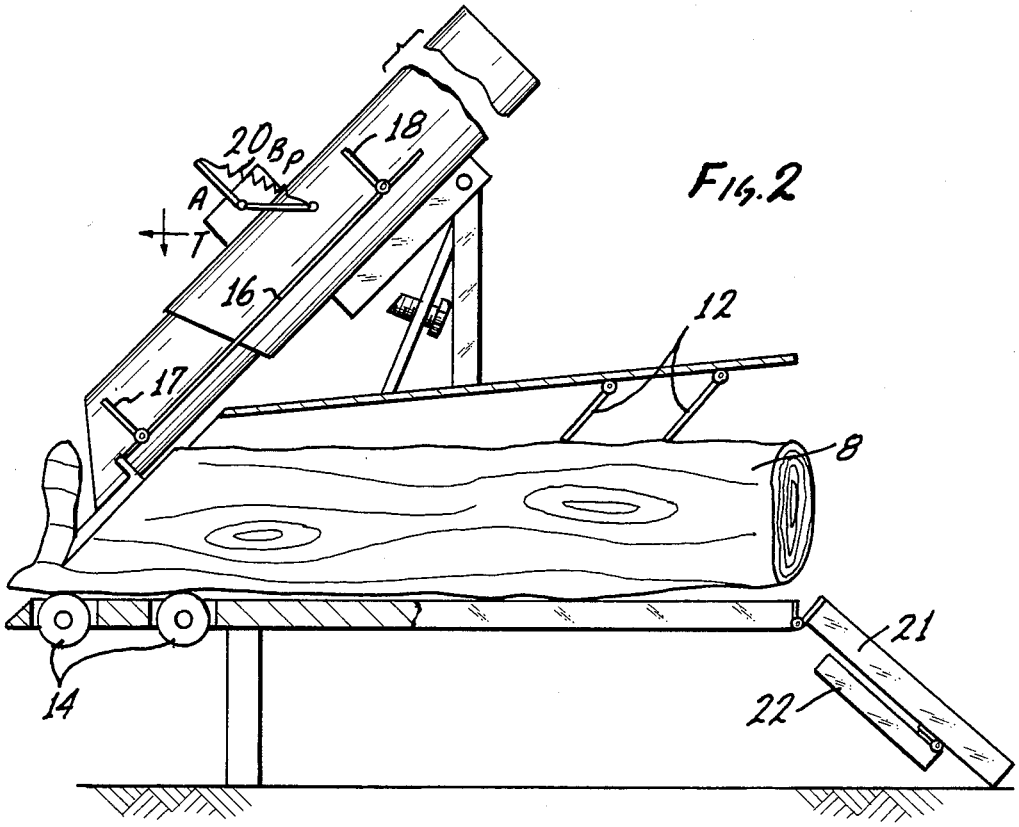
Fig. 2
Fig. 3
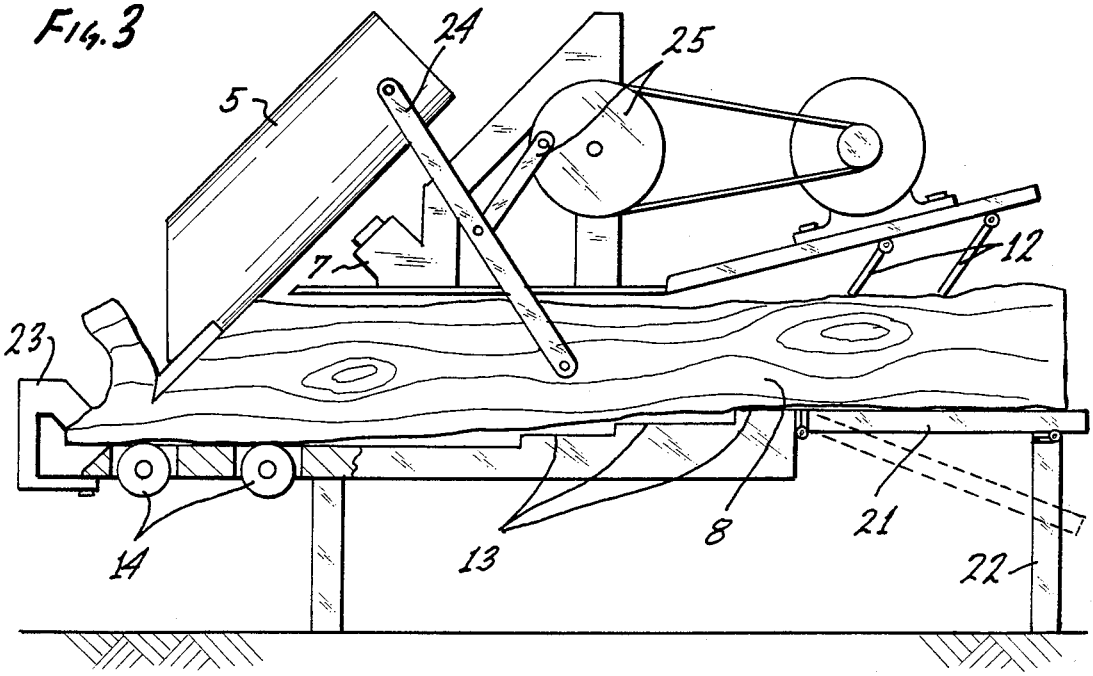

WOOD CHIPPING

This application is a continuation of application Ser. No. 770,400 filed 08/28/85, and now abandoned.

BACKGROUND OF THE INVENTION

The present invention relates to the cutting, chipping and chopping of wood and, more particularly, to a machine using a knife-like blade for cutting and chipping wood into relatively large pieces in a direction transverse, or at least approximately transverse, to the orientation and direction of the grain. Machines of the type to which the invention pertains are generally known and available in the trade. However, they all exhibit the drawback that they have a rather high requirement in power and force, and the split-off pieces of wood are not cut in the direction of the fibers and grain.

DESCRIPTION OF THE INVENTION

It is an object of the present invention to provide a new machine for cutting, chipping and chopping wood, which has a considerably lower requirement in force and power as machines known in the art.

In accordance with the preferred embodiment of the present invention, it is suggested to provide a knife-like blade oriented with regard to the angle of cutting to run between 70 and 30 degrees to the direction of fiber and grain. This oblique mode of cutting permits, in fact, a lowering of the force requirement for advancing the blade by about two thirds of the force requirement inherent in vertical cutting devices. A cut carried out with a relatively oblique angle is preferably used for cutting wood having many knots, while a shallower angle of cutting will be used for hardwood grains.

In a particular configuration of practicing the invention, a wedge and cutting angle of the cutting blade is chosen to be between 20 and 40 degrees. By virtue of this feature, it is made possible that the cut wood part is exposed to such high tension transversely to direction of the fibers and grain that the wood actually cracks and splits open along the fiber direction. This cracking and splitting open will enhance and facilitate drying of the wood and will also facilitate handling of the wood when used for heating. A particularly advantageous wedge angle for cutting European-type pinewood, independently from its moisture content, is 30 to 33 degrees. The optimum wedge angle of the blade and the angle of cutting has to be ascertained imperically within, however, the stated range.

DESCRIPTION OF THE DRAWINGS

While the specification concludes with claims, particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 2 is a partial section, partial side elevation of the machine shown in FIG. 1.

FIG. 3 illustrates the machine in a particular mode of operation but showing some modification; and FIG. 4 illustrates the machine with additional modifications and in different modes of operation.

Figure 1:
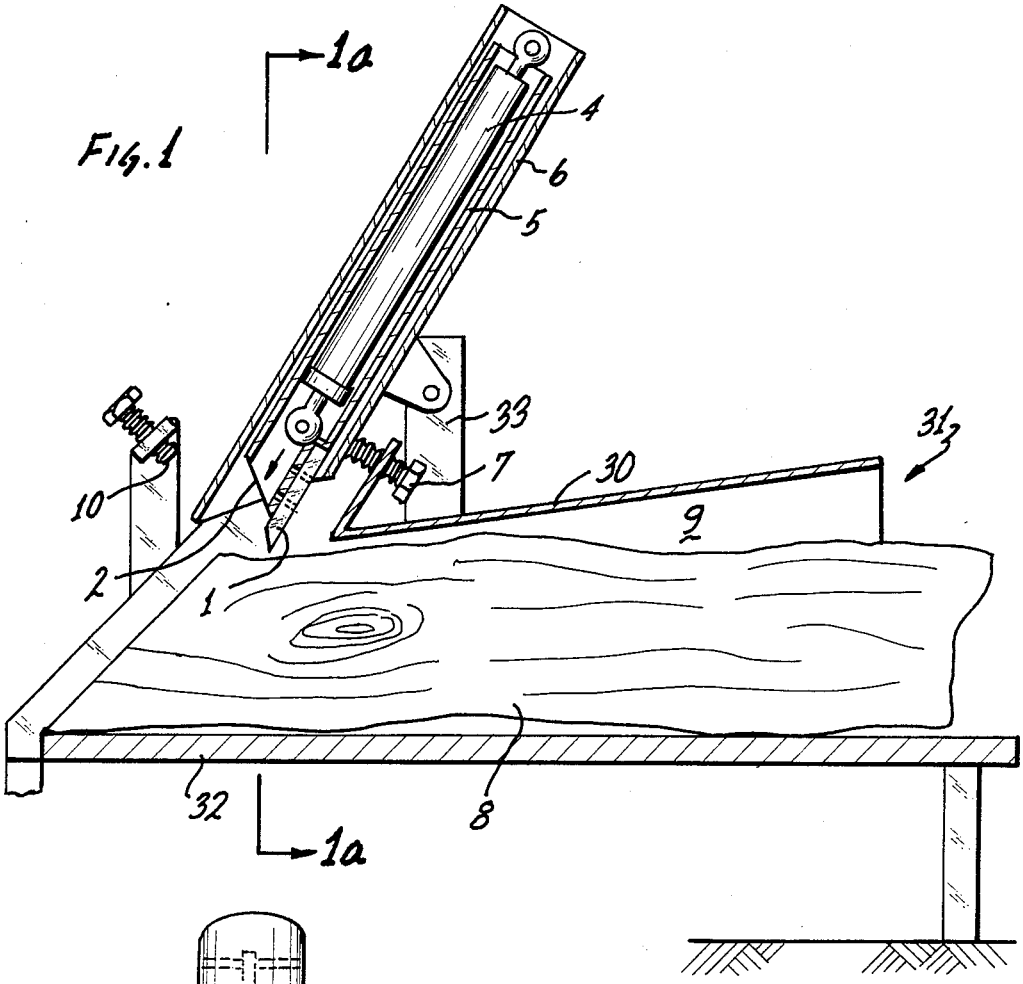
FIG. 1 is a front view of a woodchopping machine constructed in accordance with the preferred embodiment of the present invention for practicing the best mode thereof.
Figure 1A:
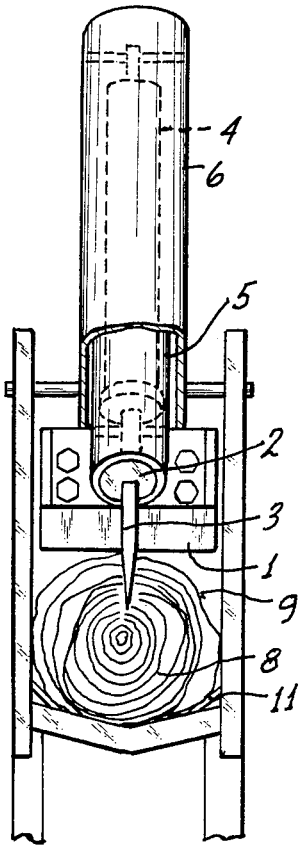

Proceeding now to the detailed description of the drawings, reference is made particularly to FIGS. 1 and 2 illustrating a tubular frame-like element 30 for receiving a log 8 in its interior, a feed channel 9, and having a funnel-shaped entrance portion 31, a bottom support 32 and a obliquely-oriented tubular slide guide or carriage guide 6 held in position by additional frame elements 33. A hydraulic cylinder 4 is mounted in a tubular guide 6 for operating the cutting facilities. The cutting arrangement includes a cutting blade 1, a wedge-like chisel member 2, and another cutter 3 for longitudinal cutting. In other words, the cutting edges of blades 1 and 3 are arranged transversely to each other. Reference numeral 5 refers to a carriage or slide member inside tubular guide 6 and the cutting blades are connected to that carriage or slide. The carriage 5 is reciprocated by the hydraulic drive 4.

One of the main purposes of the inventive device is to introduce conditions which permit natural splitting of the wood in the direction of the fibers. This effect, i.e., splitting of the wood in the direction of the grain, can be enhanced in that in continuation of the obliquely-cut blade 1, there is provided the wedge member or chisel member 2 acting basically in the same fashion, i.e., obliquely to the extension of the grain. In case the wood is very ductile, it may be necessary to use one or more of the cutting blades 3 being oriented transversely to the blade of cutter 1, as can be seen from the drawings. Particularly with regard to the log orientation, one can see that this blade or blades 3 cut the wood in direction of the fibers and grains.

An automatic advance of the wood is obtained in that the guide 6 for the carriage or slide 5 is mounted in pendulum or free-swinging fashion. FIG. 1 shows that clockwise pendulum motion is limited by a stop 10, counterclockwise motion is limited by a stop 7. As stated, the carriage or slide 5 is driven by the hydraulic drive 4. The operation is, of course, a cyclic one in that the carriage or slide 5 is reciprocated. Upon retracting the cutters, the guide 6 will pivot and impact on a stop member 7 as soon as the blades are lifted above the log 8. Thereafter, the blade is advanced by the hydraulic drive and will at first engage the log at a steeper angle, more or less behind the first surface of cutting, whereupon the log 8 is advanced in the feed channel 9 upon further advancing the blade. This advance will continue until the carriage guide 6 (pivoting clockwise in FIG. 2) abuts stop 10. Thereafter, the log is traversed by the knife at the angle of blade advance which, in effect, had been adjusted by operation of the stop 10.

Guiding the blade may also be carried out by means of a telescopic slide or under utilization of guide and linkage members 24 as shown more particularly in FIG. 4. FIG. 4 illustrates a particular example and modification of the invention using two devices 24 which take over the guiding of the knife or blades on that side which faces away from the log. Folding the blade into the steep position relative to the log 8 is carried out here by means of the stop 7. Abutment with regard to the side facing the log is either carried out by the stop 10, as shown in FIG. 1, or by a stop 23, as shown in FIG. 4. In the case stop 10 is used, the cut length will be the shorter, the thicker log 8. This is, for example, exactly what is desired in case the wood will be used for heating. In different situations, for example, if the cut product is to be the starting product, for example, for the making of cutting chips, clippings or the like, one wants a uniform length of the cut product independently from the thickness of the log. In this case, then, one uses the stop 23 shown in FIG. 4 being adjustably positioned at the end of the log feed channel 9. This way, the log is held during the cutting operation in a position which is, in fact, independent from the thickness of the log itself.

The hydraulic drive illustrated is by way of example only. Other drives can be used for moving and reciprocating the cutting blades. An alternative is specifically illustrated in FIG. 4 showing a crank drive 25 with suitable linkage, including the linkage 24. One may need some form of speed reduction in a transmission 26 from a drive motor or engine 27 to the crank drive 25. Generally speaking, it is of advantage to fold the cutting blade sufficiently far back so that is assumes an angle in relation to the duct or log feed channel 9, which is 80 and 45 degrees (in the plane of the drawing). Normally, it is to be expected that the knife or blade will pivot back to a 65 to 70 degree orientation once the log advance has begun. The farther back the blade pivots, the larger will be the cut sections as produced subsequently. Of course, the cut length can be adjusted also by means of the stop 7 as shown in FIGS. 1 and 2.

If several thin logs are placed side by side into the duct or log feed channel 9, it may be advantageous to guide them into a particular position and to prevent lateral rolling away. This means, for example, that by means of guide sheets 11 the sides of channel 9 assume a somewhat conical configuration. This way one makes sure that several logs, if they are thin, are still juxtaposed near the center of the channel 9 and will, in fact, be carried along by the blade during advance. In the alternative, it may be of advantage to provide a positive guide for the blade in a manner known per se and being constructed to make sure that the blade will begin cut only after the slide has reached the abutment stop 10.

It may also be of advantage to positively guide the blade during the lifting return or retract stroke because, if the blade bears against the log during the lifting or return stroke, the log may actually happen to be shifted back in the duct or channel 9, which is an undesirable side effect. Such a restraction of the log can, for example, be prevented by means of flaps 12 (FIG. 4) situated in the channel 9, and extending down from the top. These flaps prevent a retraction of the logs 8. Alternatively or in addition, the rear end or entrance end of the feed channel 9 may be provided with steps, such as steps 13, which in profile generally resemble a sawtooth pattern. That pattern can be, of course, denser as far as the "teeth" are concerned. In this manner, undesired retraction of the log or logs can be prevented, which means that even logs still having branch ends can be chipped without posing any problems.

The uniform advance of several logs in parallel is also obtainable by introducing or inserting rolls or rollers such as 14 into the duct, as shown in FIG. 4. These rolls make sure that the log or logs 8 will not just slide, but will be rolled forward as soon as the respective thickest log has engaged a blade is advanced by it. This advance will set these passive rolls or rollers 14 into motion, thereby carrying along all of the logs, including those not yet engaged by the blade.

The point of terminating the cutting motion is subject to adjustment. However, this point should be subject to variation itself in order to compensate for the difference in lengths of the various cutters and blades, the lengths being different on account of different grinding. After cutting, the blade configuration is retracted and returns actually into an upper dead-center position which is also subject to a fixed adjustment. This feature has the advantage that the retraction as such and stopping in particular does not depend on any experience on part of the operating personnel. However, such an adjustment is disadvantaged by the fact that the cylinder has to obtain always the extreme upper dead-center position and that, of course, slows down the cutting frequency. Therefore, it may be of advantage to provide the upper dead-center variable in that, for example, through a variable stop which controls reversal of the hydraulic or by changing the mechanical transmission in a manner known per se.

In order to avoid any kind of manual operation, it is also feasible to change the upper dead center only after the carriage abuts the stop 7. This abutment at stop 7 is an indication for the fact that the knife or blades no longer engage any log material. This holds strictly true only if there is no positive independent retraction provided for the blade or blades that is entirely independent from log engagement.

FIG. 3 illustrates a configuration for changing the operation such that the hydraulic piston is reversed in upper and lower dead-center positions. A rod 16 can be fastened in this case to the slide 5 on which are adjustably fastened stop or cam 17 for the upper dead center and 18 for the lower dead center. A hydraulic valve 19, on the other hand, is secured to the slide guide 6. This valve 19 is actuated by the stop or cam members 17 and 18 in a mechanical fashion, provided the adjustment of the letter, of course, changes the timing and phasing of this control operation. A spring 20 is provided to make sure that after reversal the valve will retain its control position, be it A or B, as shown in FIG. 3.

It is within the scope of the invention to use lifting or pendular and free swinging motion of the blade support and drive structure to advance by means of another transport facility additional log material towards the cutting machine. For example, in the case of large trees, it may of advantageous for this purpose to configure the channel 9 at the end of the machine in a foldable configuration, so that the logs can be pulled into the machine through a ramp 21 as it also shown in FIG. 3 and 4. This ramp 21 may be positioned also in a horizontal position, if that is needed and supported, by means of legs 22 shown in a folded-up position in FIG. 3 in order to accommodate short logs which otherwise may fall out of the channel. FIG. 4 shows the legs folded down so that a long log is readily supported.

The equipment may, in addition, be provided with supplemental feeder structure for the logs, such as a hydraulic gripping arm. Also, a conveyor belt may replace the ramp 21. For ease of maintenance, moreover, the carriage should be subject to being folded up above the stop 10.

In an advantageous configuration of the invention, the hydraulic system is operated with a maximum pressure of about 180 bars. For this, one will use pressurized cylinder of 100 millimeters diameter for the piston and 60 millimeters diameter for the piston rod. This, then, produces an effective pressure of 140,000 Newtons as it acts upon the blade. The lifting stroke of the cylinder is about 700 millimeters for a log diameter of maximum 400 millimeters. European hardwood and pinewoods may be processed with this device for a thickness of up to about 40 centimeters at a cutting angle of 45 degrees and a wedge angle for the blade of about 30 degrees.

The invention is not limited to the embodiments described above, but all changes and modifications thereof not constituting departures from the spirit and scope of the invention are intended to be included.

I claim:

1. In a machine for cutting, chipping or splitting wood, and including a frame and support means, drive means being mounted to the support means, a knife-like blade being connected to the drive means for being reciprocated, i.e. advanced and retracted by the drive means, the improvement comprising:

means connected to the support for adjusting the blade and, therefore the angle of cutting, between 70 degrees and 30 degrees relative to the grain fiber orientation of the wood; and a chisel-like wedge having an orientation as given by said angle of cutting, and being connected to the blade behind a cutting edge thereof and extending rearwardly therefrom, said wedge causing extended wedge action in a direction of cutting to thereby introduce internal tensional stress in cut off pieces as the advancing blade pushes the wood and causes the wood to advance.

2. The machine as in claim 1, wherein the cutting angle of the blade is between 20 and 40 degrees.

3. In a machine as in claim 1, including at least one additional cutting blade with a cutting edge oriented transversely to the cutting edge of said blade.

4. In a machine as in claim 1, the drive means including a carriage or slide for the blade; a guide for mounting the carriage or slide; means for suspending the guide in the frame means for pendulum motion; and two stops for limiting the pendulum deflection of the guide.

5. In a machine as in claim 4, said carriage or slide being mounted for tilting and folding to assume a folded-back position wherein the carriage or guide has an angle between 80 degrees and 45 degrees relative to a feeder channel for logs to be cut.

6. In a machine as in claim 5, said angle being between 65 and 70 degrees.

7. In a machine as in claim 1, including means for permitting advance of the blade only after a particular stop has been reached.

8. In a machine as in claim 1 and including means to guide the retraction of the blade into an upper dead-center position.

9. In a machine for cutting, chipping or splitting wood, and having a frame and support structure, the frame defining a direction of wood feeding as well as a direction opposite the direction of wood feeding, the combination comprising:

a carriage;

a carriage support structure pivotably suspended on the frame so that the support structure can undergo pivot motion, said carriage being movably disposed in the support structure;

drive means connected to the carriage support structure and the carriage, for advancing and retracting the carriage in relation to the support structure;

first stop means for limiting the pivot motion of the carriage support structure in the direction opposite the direction of wood feeding;

means connected to the frame for receiving and guiding the wood and permitting movement of the wood in the direction of feeding;

second stop means for limiting pivoting of the carriage support structure in the direction of feeding, and blade means mounted to the carriage and projecting from the carriage support structure, for engaging wood when the carriage support structure is in abutment with the first stop means at an angle of cutting between 20 degrees and 30 degrees relative to grain fiber orientation of the wood, whereby as the carriage advances by operation of the drive means, the blade upon cutting causes the wood to advance in the direction of feeding until the carriage support structure abuts the second stop.

10. In a machine as in claim 9, including means for reversing carriage movement in response to abutment of the carriage support structure against the first stop.

11. In a machine as in claim 9, said means for holding including a guide channel for the logs, being of a funnel-shaped configuration.

12. In a machine as in claim 11 and including means in the channel for preventing retraction of a log to be cut.

13. In a machine as in claim 12, said means for preventing including flaps on the upper side of the guide channel.

14. In a machine as in claim 12, said means for preventing including steps in the bottom of the channel.

15. In a machine as in claim 11, including idle rolls or rollers mounted in the channel.

* * * * *

UNITED STATES PATENT AND TRADEMARK OFFICE

CERTIFICATE OF CORRECTION

PATENT NO. : 4,751,949

DATED : June 21, 1988

INVENTOR(S) : Alois Berner

It is certified that error appears in the above-identified patent and that said Letters Patent is hereby corrected as shown below:

Front Sheet item (30) Foreign Application Priority Data:

Aug. 28, 1984 (DE) Fed. Rep. of Germany 34 31 550

Signed and Sealed this

Twenty-seventh Day of June, 1989

*Attest:*

DONALD J. QUIGG

*Attesting Officer*

*Commissioner of Patents and Trademarks*